United States Patent [19]

Wada et al.

[11] Patent Number: 4,945,684

[45] Date of Patent: Aug. 7, 1990

[54] METHOD OF AND APPARATUS FOR PROCESSING PERIPHERAL EDGE OF LENS FOR SPECTACLES

[75] Inventors: Toyoji Wada, Fussa; Takashi Daimaru, Ohme; Noriyasu Itoh, Fussa, all of Japan

[73] Assignee: Hoya Corporation, Tokyo, Japan

[21] Appl. No.: 247,446

[22] PCT Filed: Jan. 12, 1988

[86] PCT No.: PCT/JP88/00022

§ 371 Date: Sep. 2, 1988

§ 102(e) Date: Sep. 2, 1988

[87] PCT Pub. No.: WO88/04974

PCT Pub. Date: Jul. 14, 1988

[30] Foreign Application Priority Data

Jan. 12, 1987 [JP] Japan ..... 62-4400

[51] Int. Cl.[5] ..... B24B 17/00

[52] U.S. Cl. ..... 51/165.77; 51/165.71; 51/101 L G; 51/284 E

[58] Field of Search ..... 51/165.77, 165.71, 101 L G, 51/284 E

[56] References Cited

U.S. PATENT DOCUMENTS 3,786,600 1/1974 Bloxsom ..... 51/101 L G 4,596,091 6/1986 Daboudet et al. ..... 51/101 L G

*Primary Examiner*—Frederick R. Schmidt

*Assistant Examiner*—Maurina Rachubay

*Attorney, Agent, or Firm*—Nixon & Vanderhye

[57] ABSTRACT

A method of and an apparatus for processing a peripheral edge of a lens for spectacles are arranged such that a configuration of a lens frame of a spectacle framework is measured, and the peripheral edge of the spectacle lens is ground on the basis of data on the lens-frame configuration obtained by the measurement. In the method and apparatus, a locus of a center of a disc-shaped measuring probe moving along an inner periphery of the lens frame of the spectacle framework is first measured, and an envelope is obtained which is located on the outside of circles each having a center located on said locus and a radius equal to the sum of a radius of a columnar grindstone and a radius of the measuring probe. A rotational axis of an unprocessed lens is moved along said envelope relatively to a rotational axis of the columnar grindstone, to process a peripheral edge of the unprocessed lens.

15 Claims, 8 Drawing Sheets

METHOD OF AND APPARATUS FOR PROCESSING PERIPHERAL EDGE OF LENS FOR SPECTACLES

TECHNICAL FIELD

The present invention relates to a method of processing a peripheral edge of a lens for spectacles, and to an apparatus for carrying the method into effect, in which a configuration of a lens frame of a spectacle framework is measured, and the peripheral edge of the spectacle lens is ground on the basis of data on the lens-frame configuration obtained by the measurement

BACKGROUND ART

Processing of a peripheral edge of a lens for spectacles, in which the spectacle lens is processed in compliance with the configuration of a lens frame of a spectacle framework, has conventionally been carried out practically in such a manner that a spectacle lens to be processed is profiled on the basis of a template formed by a plain plate having the same configuration as the lens frame. In case of this profiling, the template and the lens to be processed are held in coaxial relation to each other, a follower in contact with the template and a columnar grindstone for cutting the lens are held in coaxial relation to each other, and the lens to be processed is urged against the outer peripheral surface of the grindstone to grind the lens to be processed. This profiling requires high skill in order to carry out accurate lens processing. In addition, since it is not necessarily possible for the profiling to obtain highly accurate spectacle lenses, it has been required to rectify the lens by means of manual grinding after the profiling.

Moreover, in recent years, a processing machine for peripheral edges of spectacle lens by means of a numerically-controlled system has been developed (refer to, for example, Japanese Patent Application Laid-Open No. 61-267732). In this case, the processing machine takes not only the data on the configuration of the lens template, but also data on the configuration of the lens frame of the spectacle framework directly in which these data are converted into grinding data for the lens. This processing machine comprises spectacle-framework holding means, support means supporting the spectacle-framework holding means for movement in a predetermined plane, and measuring means. This measuring means is composed of a sensor arm rotatable about an axis normal to the aforesaid plane, and a sensor movable along the sensor arm, in which the configuration of the lens frame of the spectacle framework or the configuration of the template is measured, in the form of radial data, on the basis of rotational angle of the sensor arm and an amount of movement of the sensor.

In the numerically-controlled type lens processing machine, the measuring means is complicated in mechanism, and a manner of operation is also complicated and is time-consuming. This is because it is required to obtain the geometric center of the lens frame on the basis of first data on the lens-frame configuration from the measuring means and, subsequently, again to bring the center of rotation of the sensor arm into coincidence with the geometric center, thereby obtaining a measurement value of the lens-frame configuration.

Furthermore, in cases of both the above-described arrangements, the lens is abutted against the grindstone under the own weight of the lens holder. No particular problem arises for such uniform natural fall load, if the lens is hard and thick in wall thickness like glass lens. However, if the lens is relatively soft and thin like a plastic lens, there occurs cracking of the lens, reduction in grinding accuracy, and the like.

It is therefore an object of the invention to provide a method of and an apparatus for processing a peripheral edge of a spectacle lens, capable of directly carrying out processing of the peripheral edge of the spectacle lens on the basis of data on measurement of a configuration of a lens frame of a spectacle framework.

Further, it is an object of the invention to provide a method of and an apparatus for processing a peripheral edge of a spectacle lens, in which measuring means is relatively simple in structure and it is possible to accurately measure the configuration of the lens frame.

Moreover, it is an object of the invention to provide a method of and an apparatus for processing a peripheral edge of a spectacle lens, capable of varying cutting pressure acting upon the lens depending upon the material, the wall thickness and the like of the lens.

DISCLOSURE OF THE INVENTION

A method of processing a peripheral edge of a spectacle lens, according to the invention, comprises the steps of measuring a locus of a center of a disc-shaped measuring probe moving along an inner periphery of a lens frame of a spectacle framework, obtaining an envelope surrounding circles each having a center located on said locus and a radius equal to a sum of a radius of a columnar grindstone and a radius of the measuring probe, and moving a rotational axis of an unprocessed lens along said envelope relatively to a rotational axis of said columnar grinding stone, to process a peripheral edge of the unprocessed lens.

Further, an apparatus for processing a peripheral edge of a spectacle lens, according to the invention, comprises means for moving a disc-shaped measuring probe along an inner periphery of a lens frame of a spectacle framework, means for measuring a distance between an optional point within the lens frame and a center of the measuring probe, means for measuring an angle of the center of the measuring probe on the basis of said optional point, arithmetic means for obtaining, on the basis of said distance and said angle, an envelope surrounding circles each having a center located on a locus of a center of the measuring probe and a radius equal to a sum of a radius of a columnar grindstone and a radius of the measuring probe, processing means for holding a lens to be processed to rotate the same and for urging the lens against the rotating grindstone to process the lens, and control means for moving a rotational axis of the unprocessed lens along said envelope relatively to a rotational axis of said columnar grindstone.

As described above, the arrangement of the processing method and apparatus for the peripheral edge of the spectacle lens, according to the invention, is such that after the locus of the center of the disc-shaped measuring probe moving in contact with the inner periphery of the lens frame of the spectacle framework has been measured, the envelope surrounding the circles each having the center located on the locus and the radius equal to the sum of the radius of the columnar grindstone and the radius of the measuring probe is obtained. With such arrangement, only a single measurement of the locus of the center of the measuring probe makes it possible to easily and quickly obtain the locus, in the form of the envelope, which should be taken by the rotational axis of the columnar grindstone relatively to the unprocessed lens when the peripheral edge of the lens is processed. Thus, the above-mentioned relative movement along the envelope enables the peripheral edge of the unprocessed lens to be processed automatically.

BEST MODE OF CARRYING OUT THE INVENTION

An embodiment of the invention will be described below in detail with reference to the accompanying drawings.

Figure 1:
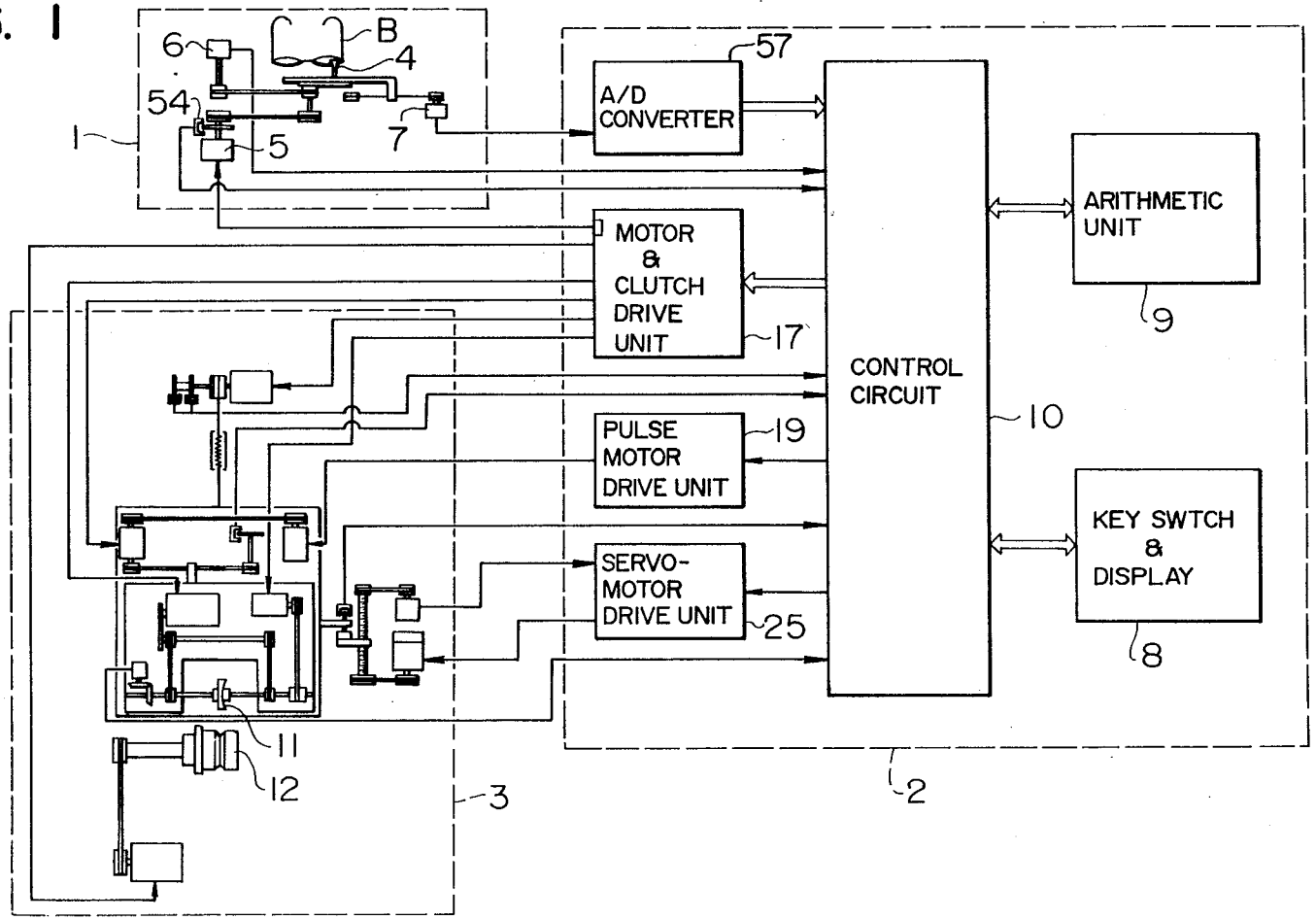
FIG. 1 is a block diagram diagrammatically showing a numerically-controlled type processing apparatus for a peripheral edge of a lens, according to the invention.

FIG. 1 diagrammatically shows the entirety of an apparatus for processing a peripheral edge of a lens for spectacles, according to the invention. The spectacle-lens processing apparatus comprises a measuring section 1 for directly measuring a lens frame of a spectacle framework to obtain data on a configuration of the lens frame, a control section 2 for controlling a processing section subsequently to be described, on the basis of the data from the measuring section 1 and lens data inputted, and the processing section 3 controlled by the control section 2 for processing an unprocessed circular lens to predetermined configuration and size.

The lens-frame configuration measuring section 1 is designed to hold the spectacle framework B and to move a disc-shaped measuring probe 4 while rolling along a V-shaped inner groove in the lens frame of the spectacle framework B, thereby detecting motion of the measuring probe 4. The reference numeral 5 denotes a motor for moving the measuring probe 4 in orbital motion; 6, an encoder for measuring an orbital angle of the measuring probe 4; and 7, a potentiometer for measuring displacement of the measuring probe 4.

The aforementioned control section 2 includes a key switch and display 8, an arithmetic unit 9 and a control circuit 10. The key switch and display 8 inputs and displays the lens data such as an axial angle of astigmatism, an amount of deviation between an optical center of the lens and a center of the lens frame, and the like. The arithmetic unit 9 is adapted to calculate the data on the lens-frame configuration from the measuring section 1 and the lens data from the key switch and display 8. The control circuit 10 is provided with a memory and a CPU for controlling the processing section subsequently to be described, on the basis of the calculation results.

The aforesaid lens processing section 3 is adapted to hold a lens 11 to be processed to rotate the same, and to urge the lens 11 against a rotating grindstone 12 thereby processing the lens 11.

The lens-frame configuration measuring section 1, the control section 2 and the lens processing section 3 of the above-mentioned spectacle-lens peripheral-edge processing apparatus will next be described in detail in order.

Figure 2:
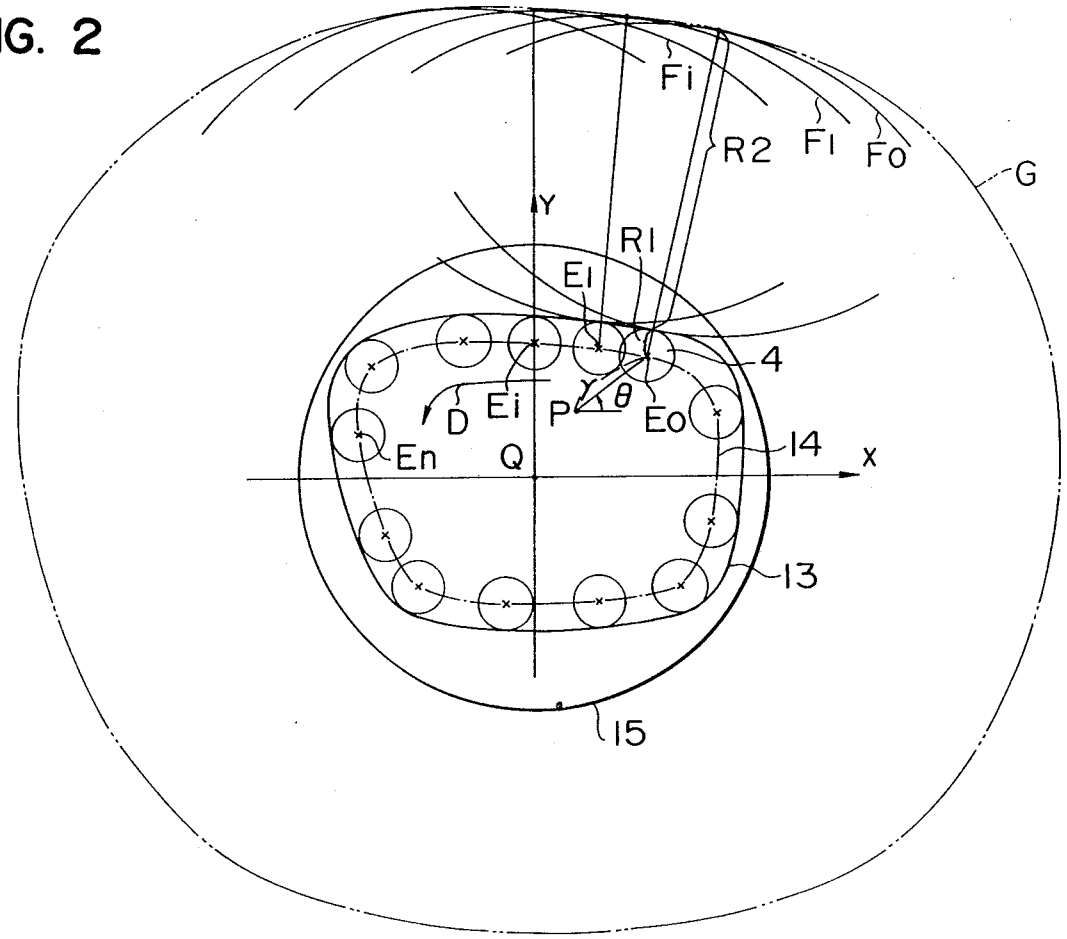
FIGS. 2 and 3 are diagrammatic views showing the principle of a method of measuring a configuration of a lens frame.
Figure 3:
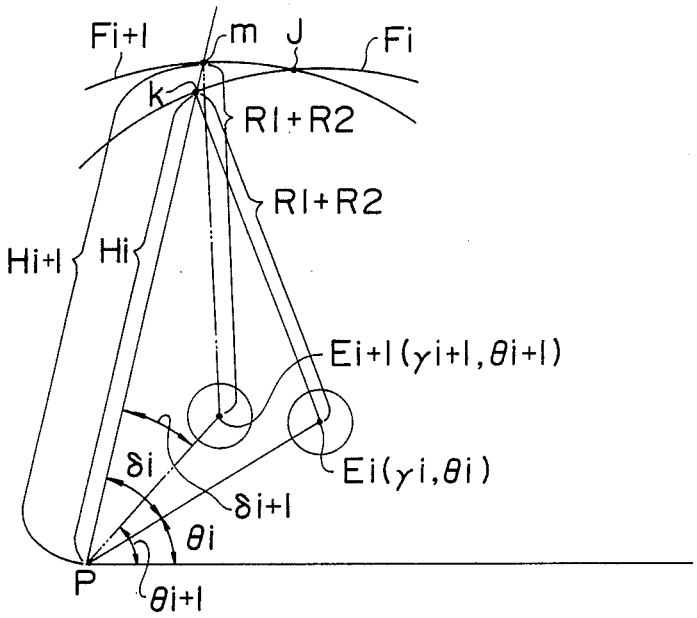

FIGS. 2 and 3 show the measurement principle of the lens-frame configuration measuring section 1. In FIG. 2, a closed curve 13 represents an inner peripheral configuration of a right-hand lens frame of the spectacle framework and, more specifically, a configuration of a bottom of a V-shaped lens-fitting groove in the lens frame. The disc-shaped measuring probe 4 having a small radius R1 is moved along the inner periphery of the curve 13. This radius R1 is selected to a value smaller than the minimum value of the radius of curvature of the curve 13. The disc-shaped measuring probe 4 is first located with its center E at an initial position $E_0$, and is then moved in a direction D while inscribing the curve 13, so that the center E describes a locus indicated by a curve 14. This locus 14 can be represented by a system of polar coordinates centering around an optional point P within the lens frame 13. That is, when the point E moves, a distance $\gamma$ from the point P to the point E and an angle $\theta$ defined by the line P - E with respect to the direction of the horizontal axis of the lens frame 13 are measured, whereby the point E can be obtained by the equation $E=E(\gamma, \theta)$.

For example, when the disc-shaped measuring probe 4 moves from the initial point $E_0$ in the direction D, the position of the point E is obtained on the basis of the polar coordinates $E_0(\gamma_0, \theta_0)$, $E_1(\gamma_1, \theta_1) \ldots E_n(\gamma_n, \theta_n) \ldots$ at each time a predetermined minute time $\Delta t_0$ expires from a point of time $t_0$ at the initial position $E_0$. Here, $E_n(\gamma_n, \theta_n)$ represents the position of the center E at the point of time $t_0+n\Delta t$.

An envelope G surrounding circles F is next obtained. Each of the circles F has a center located on the locus 14, and a radius equal to the sum (R1+R2) of the radius R1 of the disc-shaped measuring probe 4 and a radius R2 of the columnar grindstone 12.

More specifically, of the circles F whose respective centers are located at positions $E_0, E_1, \ldots, E_i \ldots, E_n \ldots$, an arcuate section is obtained which has the longest distance from the point P. To this end, as shown in FIG. 3, two points $k(H_i, \theta_i+\delta_i)$ and $m(H_{i+1}, \theta_i+\delta_i)$, for example, are considered, the former of which exists on the arc $F_i$ when the center E of the disc-shaped measuring probe 4 is located at $E_i$ and the latter of which exists on the other arc when the center $E_i$ of the measuring probe 4 is located at a subsequent point $E_{i+1}$, at the equal angles $(\theta_i+\delta_i)$ in representation of the polar coordinates centering around P, and $H_i$ and $H_{i+1}$ are compared in magnitude with each other.

In this connection, $H_i$ and $H_{i+1}$ are as follows:

$$H_i = \gamma_i \cos \delta_i + \sqrt{(R1 + R2)^2 - (\gamma_i \sin \delta_i)^2} \ ,$$

and

-continued $$H_{i+1} = \gamma_{i+1} \cos \delta_{i+1} + \sqrt{(R1 + R2)^2 - (\gamma_{i+1} \sin \delta_{i+1})^2}$$

where $\delta_{i+1}=(\delta_i+\theta_i)-\theta_{i+1}$.

In a range of $H_i > H_{i+1}$, $F_i$ is selected as an approximate line of the envelope G, while in a range of $H_{i+1} > H_i$, $F_{i+1}$ is selected as an approximate line of the envelope G.

The above comparative selecting operation of the arcs $F_i$ and $F_i+F_{i+1}$ at the respective adjacent centers $E_i$ and $E_{i+1}$ is repeated from i=0 to the last value, whereby the lines approximate to the envelope can be obtained in the following form:

$$G = \begin{cases} F_0(\delta_{0,min} \leqq \delta_0 \leqq \delta_{0,max}) \\ F_1(\delta_{0,min} \leqq \delta_1 \leqq \delta_{1,max}) \\ \cdot \\ \cdot \\ \cdot \\ F_i(\delta_{i,min} \leqq \delta_i \leqq \delta_{i,max}) \\ F_{i+1}(\delta_{i+1,min} \leqq \delta_{i+1} \leqq \delta_{i+1,max}) \\ \cdot \\ \cdot \\ \cdot \end{cases} \quad (1)$$

In this connection, assuming that the angle of an intersection J between the arcs $F_i$ and $F_{i+1}$ in FIG. 2 is the aforesaid polar coordinate representation $\gamma_i$, $\delta_{i,max}$ and $\delta_{i+1,min}$ are as follows:

$\delta_{i,max}=\delta_i-\theta_i$, and $\delta_{i+1,min}=\alpha_i\theta_{i+1}$.

In this connection, if the approximate envelope G is utilized in a digital numerically-controlled unit subsequently to be described, there may beforehand be obtained, in place of the above equation (1), data on the coordinates of a multiplicity of positions which satisfy the equation (1) and which are dispersed relatively uniformly.

In calculation of the above envelope G, there may not be obtained the geometric center Q of the lens frame and a lens 15.

If desired for processing of the peripheral edge of the lens at a subsequent step, the position of an optional point g on the envelope G in FIG. 2 may be converted from the polar coordinate representation (p, $\theta_p$) centering around the point P to the polar coordinate representation ($\gamma_Q$, $\theta_Q$) centering around the geometric center Q.

In this connection, here, $\gamma_Q$ and $\theta_Q$ are as follows:

$$\gamma_Q = \sqrt{(\gamma_P \cos \theta_P - \Delta_X)^2 + (\gamma_P \sin \theta_P - \Delta_Y)^2},$$

and $$\theta_Q = \arctan\left(\frac{\gamma_P \sin \theta_P - \Delta_Y}{\gamma_P \cos \theta_P - \Delta_X}\right)$$

In this connection, ($\Delta_X$, $\Delta_Y$) is the position vector of the point P with respect to the point Q when the horizontal direction is regarded as an x-axis and the direction normal to the horizontal direction is regarded as a y-axis.

The actual construction of the measuring section 1 for measuring the lens-frame configuration in accordance with the aforementioned measuring principle will next be described with reference to FIGS. 4 through 6.

Figure 4:
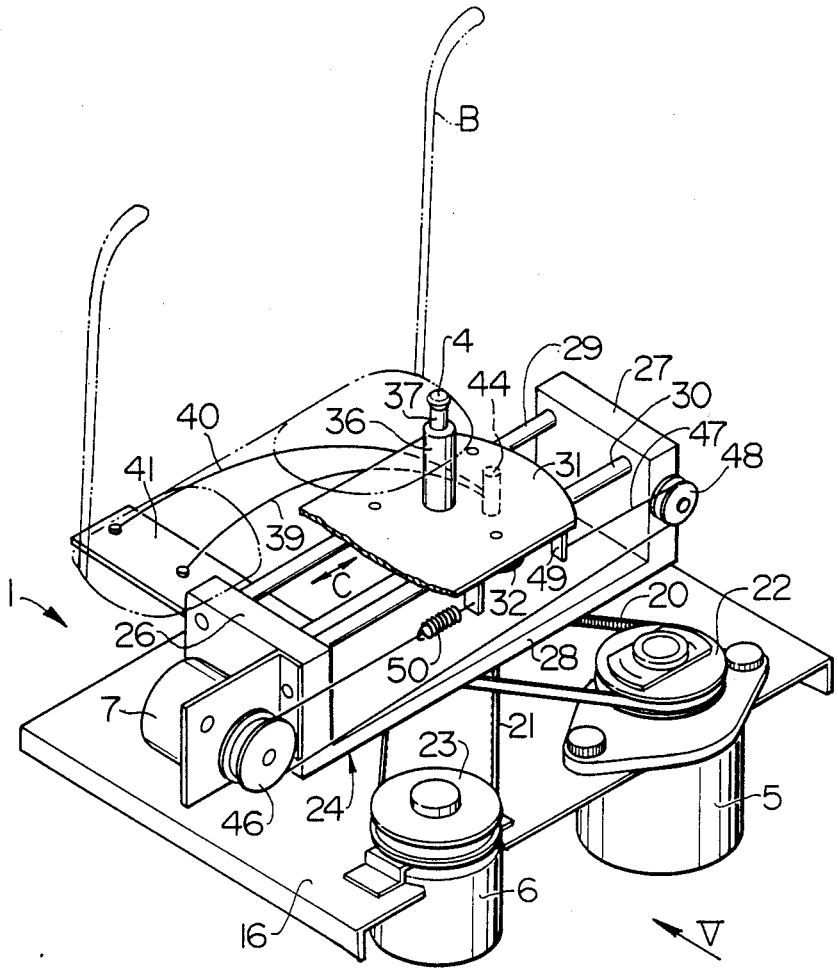
FIG. 4 is a perspective view of a lens-frame configuration measuring section of the lens peripheral-edge processing apparatus.
Figure 5:
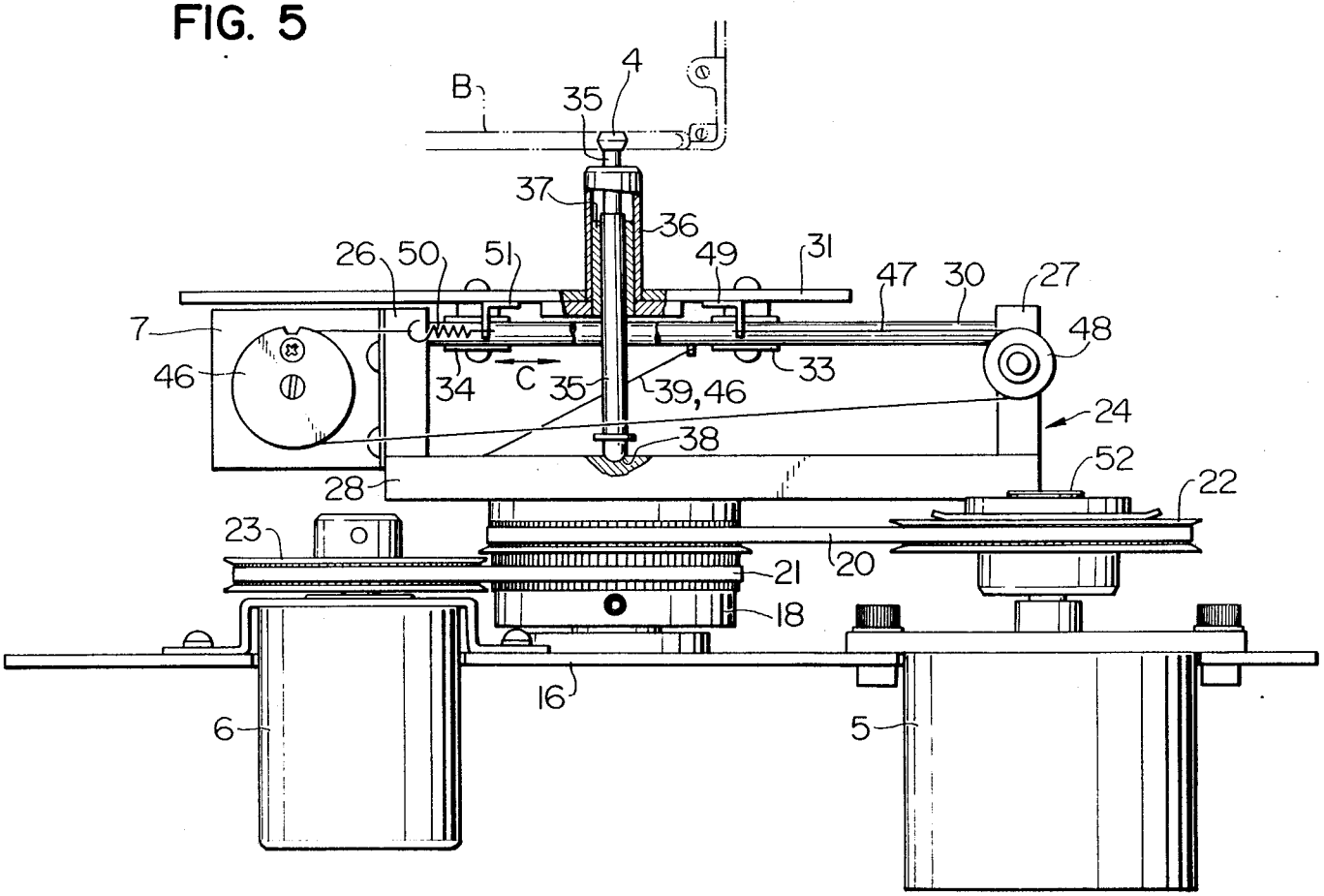
FIG. 5 is a view of the lens-frame configuration measuring section as viewed from the arrow V in FIG. 4.
Figure 6:
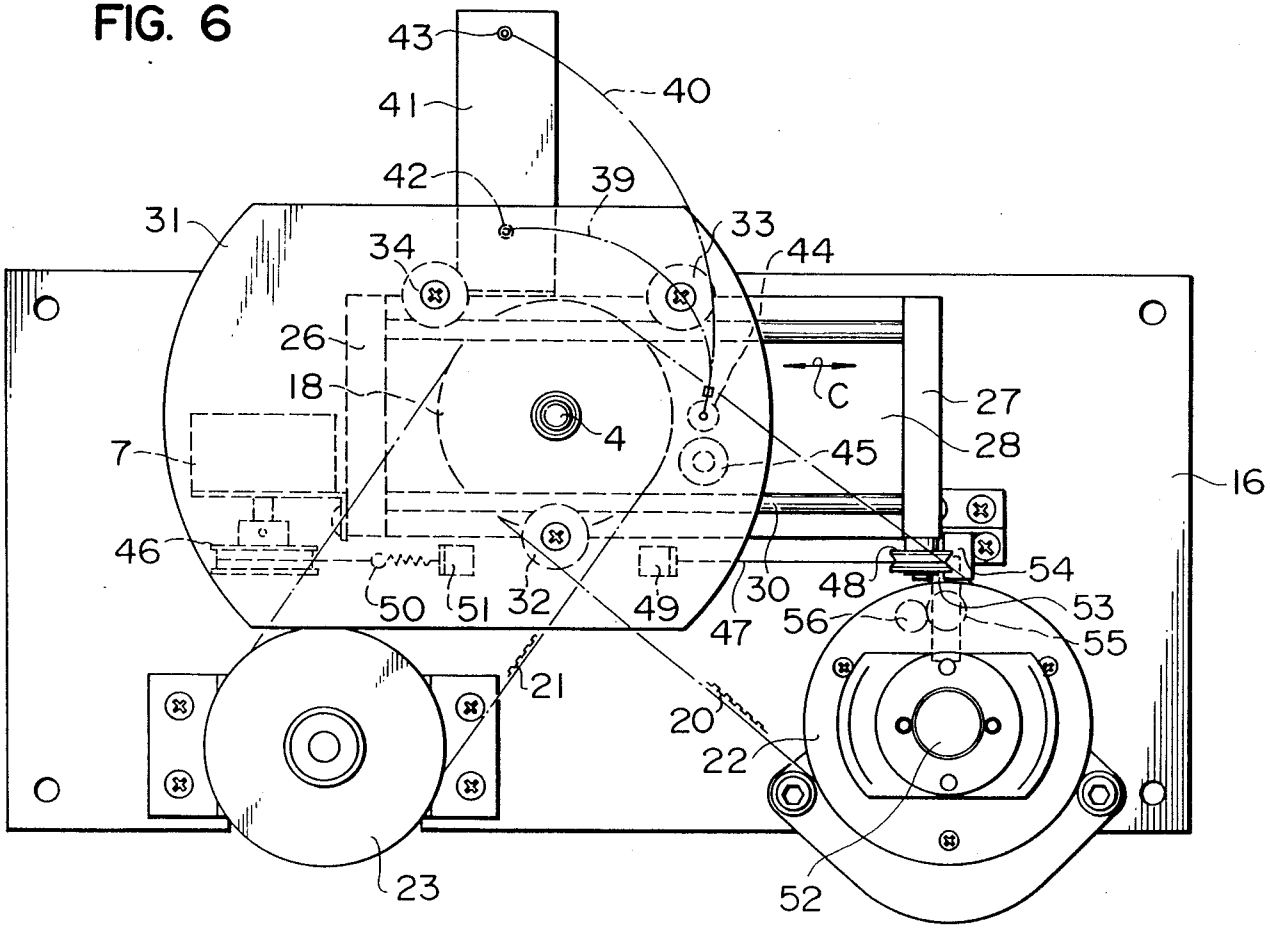
FIG. 6 is a plan view of the lens-frame configuration measuring section.

FIG. 4 is a perspective view of the lens-frame configuration measuring section 1 from which spectacle-framework holding means such as a frame table and the like are removed, FIG. 5 is a view of the lens-frame configuration measuring section 1 as viewed from the arrow V in FIG. 4, and FIG. 6 is a plan view of the lens-frame configuration measuring section 1. The spectacle framework B is fixedly held in position by the framework holding means which is not shown.

The lens-frame configuration measuring section 1 has a base plate 16 to which the drive motor 5, a rotary shaft 18 and the rotary encoder 6 are mounted. The rotary shaft 18 is rotatably supported by the base plate 16, and is connected to a pulley 22 of the drive motor 5 and to a pulley 23 of the rotary encoder 6 respectively through timing belts 20 and 21. In this connection, the pulley of the drive motor 5 has a diameter slightly larger than that of each of the rotary shaft 18 and the rotary encoder 6, and the diameter of the rotary shaft 18 is the same as that of the rotary encoder 6.

A U-shaped rotary table 24 is fixedly mounted to an upper end of the rotary shaft 18. This rotary table 24 is composed of a side plate (hereinafter referred to as "first side plate") 26 on the side of a potentiometer 25, a side plate (hereinafter referred to as "second side plate") 27 on the side opposite to the first side plate 26, and a rectangular central plate 28 connecting both the side plates to each other. The rotary table 24 is rotatable by the drive motor 5 through the timing belts 20 and 21 and the rotary shaft 18.

Further, a pair of guide shafts 29 and 30 are fixedly mounted in parallel relation to each other between the first side plate 26 and the second side plate 27. Along both the guide shafts 29 and 30, a horizontal slide plate 31 is guided for sliding movement in a longitudinal direction C of the guide shafts. For this guidance, the slide plate 31 is provided at its lower surface with three rotatable rollers 32, 33 and 34. In this case, one of the rollers 32 is in contact with one of the guide shafts 30, while the remaining two rollers 33 and 34 are in contact with the other guide shaft 29. These one and remaining rollers roll respectively along the one and other guide shafts, with the guide shafts clamped between the one and remaining rollers.

The measuring probe 4 is held by the slide plate 31. This measuring probe 4 is mounted to an upper end of a shaft 35 extending through the slide plate 31. This shaft 35 is born rotatably and vertically movably by a plain bearing 37 within a sleeve 36 fixedly mounted to the slide plate 31. The shaft 35 has a lower end which is placed on the central plate 28 of the rotary table 24 for sliding movement on the central plate 28. The central plate 28 is formed with a recess 38 at a location on an extension line of the longitudinal axis of the rotary shaft 18. The lower end of the shaft 35 can be fitted into the recess 38. The position of the recess 38 serves as the reference position P of the measuring probe 4.

The slide plate 31 is biased toward the second side plate 27 by a pair of biasing springs 39 and 40 formed of piano wires. The springs have their respective one ends which are anchored respectively to spring attaching bores 42 and 43 in a spring hooking plate 41 fixedly mounted to the longitudinal side face of the central plate 28 of the rotary table 24 by means of screws. The other ends of the respective springs are connected to a spring hooking pin 44 mounted to the lower surface of the slide plate 31, at a location adjacent the second side plate 27.

By the action of the biasing springs 39 and 40, the slide plate 31 tends to move toward the second side plate 27 along the guide shafts 29 and 30. Accordingly, the measuring probe 4 held by the slide plate 31 is urged against the inner peripheral groove in the lens frame of the spectacle framework B under the elastic force of the biasing springs 39 and 40. In this connection, a stopper pin 45 covered with shock absorbing material (rubber) is mounted to the lower surface of the slide plate 31 at a location closer to the second side plate 27 than the spring hooking pin 44. This stopper pin 45 restricts the movable range of the slide plate 31 toward the second side plate 27.

Moreover, the potentiometer 7 is mounted to the outer surface of the first side plate 26 of the rotary table 24. A wire rope 47 runs on a pulley 46 of the potentiometer 7. The wire rope 47 further runs on a guide pulley 48 mounted to the second slide plate 27 and is turned thereby. The wire rope 47 has one end which is anchored to an L-shaped wire attaching element 49 fixedly mounted to the lower surface of the slide plate 31. The other end of the wire rope 47 is attached to one end of a tension spring 50. The opposite end of the tension spring 50 is anchored to an L-shaped spring attaching element 51 which is fixedly mounted to the lower surface of the slide plate 31.

As the slide plate 31 moves along the guide shafts 29 and 30, the wire rope 47 causes the potentiometer pulley 46 to be rotated, whereby the potentiometer 7 detects, as a change in rotational angle of the potentiometer pulley 46, an amount of movement of the slide plate 31 along the guide shafts 29 and 30, in turn, a displacement $\gamma$ of the measuring probe 4 from the reference position P in the direction C.

Furthermore, since the rotary shaft 18 is connected to the rotary encoder 6 through the timing belt 21, the rotational angle of the rotary shaft 18, in turn, the orbital angle of the measuring probe 4 from the reference position P is detected, in the form of an electric signal, by the rotary encoder 6.

An interrupting plate 53 is fixedly mounted to a drive shaft 52 of the aforementioned drive motor 5. A photo-interrupter 54 is fixedly mounted to the base plate 16 at a location on a rotational orbit of the interrupting plate 53. The photo-interrupter 54 detects the origin position of the motor 5 and inputs the same to the control circuit. A stopper abutment pin 55 is mounted to the base plate 16 at a location between the photo-interrupter 54 and the center of the drive shaft 52 of the motor 5. A rod-like stopper 56 extending downwardly is mounted to the pulley 22 of the motor 5. This stopper 56 cooperates with the stopper abutment pin 55 to restrict the rotatable range.

The frame-configuration measuring section 1 constructed as above operates in the following manner.

The spectacle framework B to be measured is placed in position on the frame table which is not shown, and the spectacle framework B is fixedly held by a frame holding member which is not also shown.

Subsequently, the measuring probe 4 is brought into contact with the V-shaped groove in the inner surface of the lens frame of the spectacle framework. The contact pressure between the measuring probe 4 and the V-shaped groove is given by the aforementioned biasing springs 39 and 40. In this state, as the drive motor 5 is driven, the rotary shaft 18 is rotated, and the measuring probe 4 is moved while rolling along the V-shaped groove in the lens frame by rotational movement of the rotary table 24 about the rotary shaft 18 and sliding movement of the slide plate 31 along the guide shafts 29 and 30 due to the elastic force of the biasing springs 39 and 40.

At a point of time the measuring probe 4 revolves once, rotation of the motor 5 is stopped by one revolution of the rotary encoder 6. The rotational angle $\theta$ of the rotary table 24 and the sliding displacement $\gamma$ of the measuring probe 4 during a period of one orbital movement of the measuring probe 4 along the lens frame are detected respectively by the rotary encoder 6 and the potentiometer 7. Likewise, the opposite lens frame is measured, as occasion demands, by means similar to that described above.

The rotational angle $\theta$ of the rotary table 24 is inputted directly to the control circuit 10, while the sliding displacement $\gamma$ of the measuring probe 4 is inputted to the control circuit 10 through an A/D converter 57 (see FIG. 1). On the basis of these data on the lens-frame configuration, the envelope G is obtained at the arithmetic unit 9 under the control of the control circuit 10, and data corresponding to the envelope G are stored in the memory.

The processing section 3 and the control section 2 will next be described in detail. The processing section 3 is shown in detail in FIG. 7. The processing section 3 comprises a U-shaped box-like carriage 58 for supporting, rotating and moving the lens 11 to be processed. This carriage 58 is guided for movement on a base of the processing section 3 and on a guide plate 77 on the base, in an X-axis direction and a Y-axis direction. By the movement of the carriage 58 in the Y-axis direction, the lens 11 is urged against the rotating grindstone 12 and is ground thereby.

A lens holding shaft 59 and a lens clamping shaft 60 for clamping therebetween the unprocessed lens 11 are rotatably arranged in front of the carriage 58. The lens holding shaft 59 is supported against axial movement, and is provided at its free end with a holding member such as a suction disc or the like. The lens clamping shaft 60 is supported for movement toward and away from the lens holding shaft 59, that is, for axial movement. Arranged within the carriage 58 is a lens driving AC motor 61 for rotating the lens holding shaft 59 and the lens clamping shaft 60 in synchronism with each other. This motor 61 is connected to the lens holding shaft 59 through gears 62 and 63, a pulley 64, a belt 65 and a pulley 66, and is connected to the lens clamping shaft 60 through the gears 62 and 63, a rod 67, a pulley 68, a belt 69 and a pulley 70. Further arranged within the carriage 58 is a lens chucking DC motor 71 for axially moving the lens clamping shaft 60. This motor 71 is connected to the lens clamping shaft 60 through a pulley 72, a belt 73 and a mechanism 74 (for example, a rack and pinion mechanism) for converting rotation to reciprocative motion. Axial movement of the lens clamping shaft 60 makes it possible to hold the lens 11 between the lens clamping shaft 60 and the lens holding shaft 59. In this connection, the aforesaid pulley 70 is connected to the lens clamping shaft 60 through a spline, enabling the lens clamping shaft 60 to be moved axially. The above-mentioned lens driving AC motor 61 and lens chucking DC motor 71 are controlled by a motor and clutch drive unit 17 as shown in FIG. 1.

A rotary encoder 76 is connected further to the lens holding shaft 59 through a bevel gear arrangement 75. This rotary encoder 76 supplies a lens rotational angle signal to the control circuit 10, as shown in FIG. 1.

The carriage 58 is movable on the guide plate 77 in the X-axis direction, and the guide plate 77 having carried thereon the carriage 58 is movable on the base of the processing section 3 in the Y-axis direction. For the movement of the carriage 58 in the X-axis direction, an X-axis direction driving pulse motor 78 under the control of a pulse motor drive unit 19 (see FIG. 1) is stationarily mounted on the guide plate 77 at a location on the outside of the carriage 58. This motor 78 is connected to an electromagnetic clutch 82 through a pulley 79, a belt 80 and a pulley 81. A belt 85 runs on and extends between a pulley 83 mounted to the electromagnetic clutch 82 and another pulley 84 mounted to the guide plate 77. An X-axis direction moving plate 86 is fixed midway of the belt 85 so as to clamp the belt. Since the moving plate 86 is fixedly mounted to the side face of the carriage 58, driving of the pulse motor 78 causes the carriage 58 to be moved in the X-axis direction. By the movement of the carriage 58 in the X-axis direction, the lens 11 supported by the carriage 58 is moved in the X-axis direction relatively to the grindstone 12. This makes it possible to move the lens 11 to positions corresponding respectively to various grinding sections on the outer peripheral surface of the grindstone 12, which include a rough grinding section, a V-shaped (bevel) grinding section and the like. A sensor (photo-interrupter) 88 for positioning the origin in the X-axis direction is mounted to a rotary shaft 87 of the pulley 84. This sensor 88 supplies a signal indicative of the position of the carriage 58 in the X-axis direction, to the control circuit 10. In this connection, the movement of the carriage 58 in the X-axis direction may be carried out by a rack and pinion mechanism.

Movement of the carriage 58 in the Y-axis direction will next be described. The carriage 58 together with the guide plate 77 is guided so as to slip down under their own weight toward the grindstone 12 along inclined guide rails which are not shown. Only this natural fall will cause the lens 11 to be strongly urged against the grindstone. For this reason, the arrangement of the embodiment is such that the carriage 58 is biased upwardly to enable adjustment of the abutting load, that is, the cutting pressure of the lens 11 with respect to the grindstone 12. To this end, the guide plate 77 having carried thereon the carriage 58 is hung down by a wire rope **89*a*, 89*b* extending in the Y-axis direction. This wire rope can be wound up about a winding drum 91 of a wire-rope winding AC motor 90. A cutting-pressure adjusting spring 93 accommodated in a sleeve 92 is anchored midway of the wire rope 89*a*, 89*b***.

Figure 7:
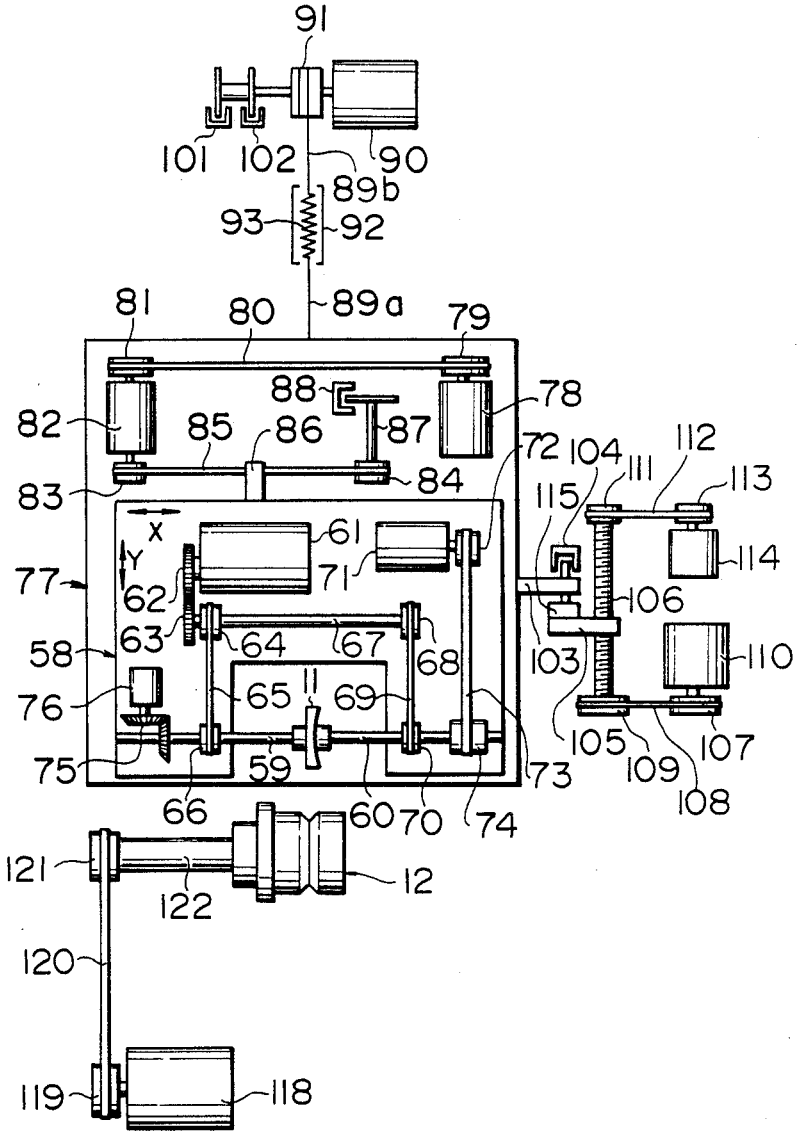
FIG. 7 is a schematic view of a lens processing section of the lens peripheral-edge processing apparatus.
Figure 8:
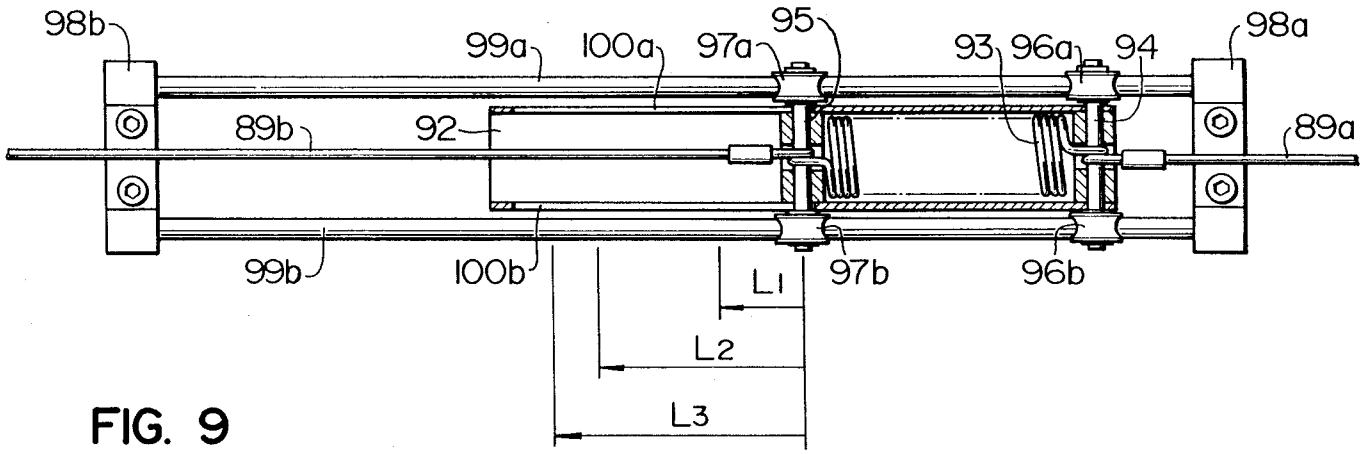
FIG. 8 is a view showing a cutting-pressure adjusting mechanism.
Figure 9:
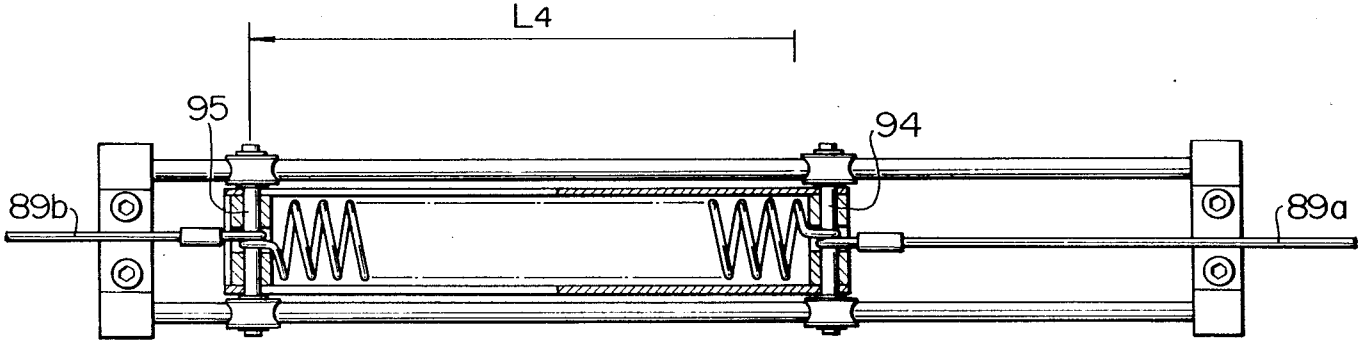
FIG. 9 is a view showing a state in which a carriage is pulled up by the cutting-pressure adjusting means shown in FIG. 8.

FIGS. 8 and 9 show in detail the sleeve 92 and the cutting-pressure adjusting spring 93. In both the figure, a right-hand end of the right-hand wire rope section **89*a* is anchored to the guide plate 77 having carried thereon the carriage 58, while a left-hand end of the wire rope section 89*a* is anchored to a right-hand end of the cutting-pressure adjusting spring 93 through a shaft 94. A right-hand end of the left-hand wire rope section 89*b* is anchored to a left-hand end of the cutting-pressure adjusting spring 93 through a shaft 95, while a left-hand end of the rope section 89*b* is wound about the winding drum 91 of the wire-rope winding AC motor 90. The shafts 94 and 95 are provided at their both ends with respective rotatable rollers 96*a* and 96*b* and 97*a* and 97*b*. These rollers are movable along guide rods 99*a* and 99*b* extending between guide-rod attaching blocks 98*a* and 98*b*. Although the cutting-pressure adjusting spring 93 in the embodiment is a coiled spring, the adjusting spring 93 may be another kind of spring or elastic element. The sleeve 92 accommodates the cutting-pressure adjusting spring 93, and a right-hand end of the sleeve 92 is fixedly mounted to the shaft 94. The sleeve 92 is provided at its left-hand end with a pair of slits 100*a* and 100*b* diametrically opposed to each other. The aforesaid shaft 95 is inserted into these slits for movement longitudinally of the wire rope 89*b*. Mounted to the winding drum 91 of the wire-rope winding AC motor 90 are, as shown in FIG. 7, an origin position sensor 101 formed by a photo-interrupter for detecting the origin position of the carriage 58, and a winding-amount sensor 102 likewise formed by a photo-interrupter for detecting an amount of winding of the wire rope 89*b***.

FIG. 8 shows a state in which the wire rope **89*b* is completely unwound from the winding drum 91. When a lens requiring relatively high cutting pressure, for example, a lens thick in wall thickness and formed of glass, is cut, the wire rope 89*b* is wound up by $L_1$ from the state of FIG. 8 by the winding drum 91, so that the shaft 95 slightly moves along the slits 100*a* and 100*b*, and the spring 93 is stretched slightly. In this state, hoisting force acting upon the guide plate 77 and the carriage 58 upwardly in the Y-axis direction due to the spring 93 is weak so that the lens 11 is abutted against the grindstone 12 relatively strongly under the own-weight falling action of the carriage 58 and the guide plate 77. When, for example, a lens is processed which is thin in wall thickness and which is formed of plastics, the wire rope 89*b* is wound up by $L_2$. The wire rope 89*b* is wound up by $L_3$ when the configuration of the peripheral edge of the lens after having been cut is measured. When the wire rope 89*b* is wound up by $L_2$ or $L_3$, the shaft 95 moves largely along the slits 100*a* and 100*b*, to stretch the spring 93 largely. This increases the hoisting force acting upon the guide plate 77 and the carriage 58 due to the spring 93, so that the own-weight falling action of the carriage 58, in turn, the abutting force of the lens with respect to the grindstone 12 is weakened. The winding amounts $L_1$, $L_2$ and $L_3$ are detected by the winding-amount sensor 102. As cutting of the lens is completed, the motor 90 is further rotated so that the wire rope 89*b* is wound up by $L_4$. At this time, the shaft 95 is first abutted against the left-hand ends of the respective slits 100*a* and 100*b*. The wire rope 89*b* is further wound up so that the rollers 96*a* and 96*b* and 97*a* and 97*b* move to the left along the guide rods 99*a* and 99*b*, and the shaft 94 moves to the left as shown in FIG. 9. Accordingly, the carriage 58 is pulled up in the Y-axis direction through the wire rope 89*a*, and is moved to a position remotest from the grindstone 12, that is, to the origin position. This origin position is detected by the origin position sensor 101**.

Figure 10:
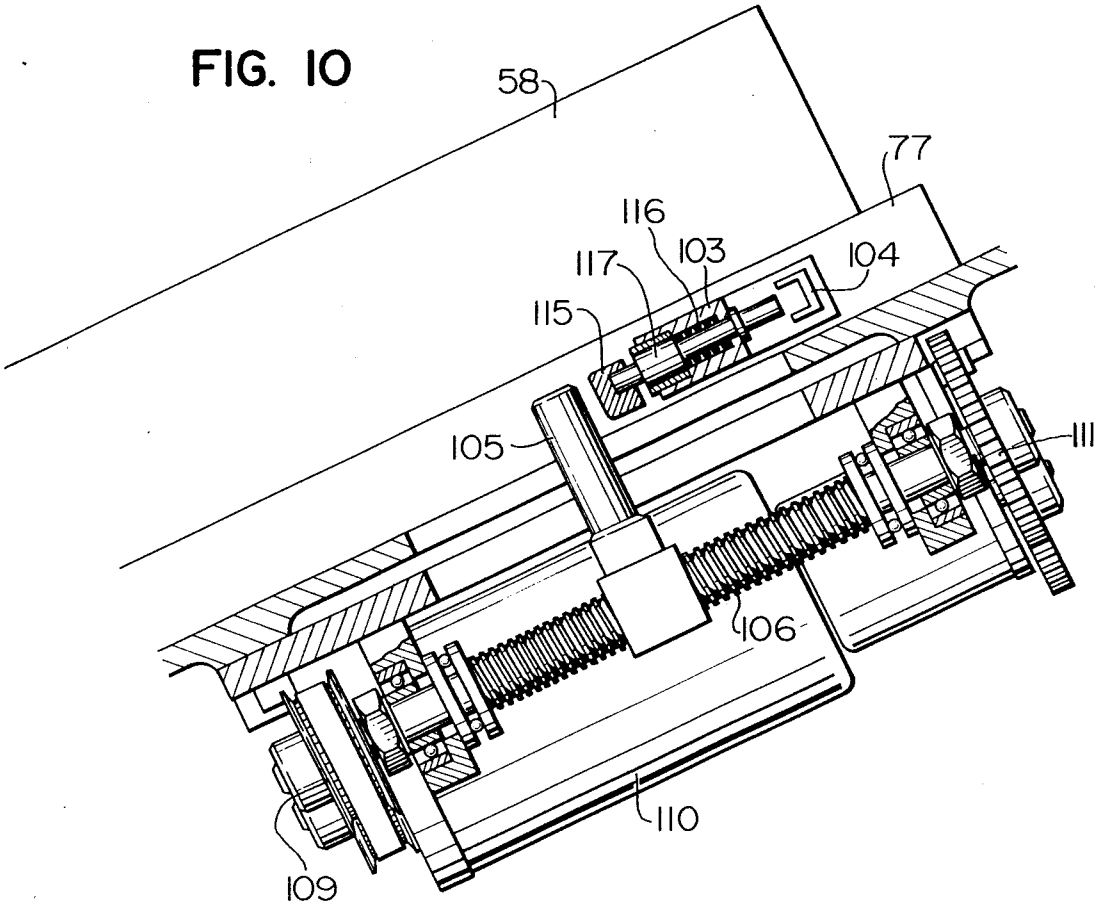
FIG. 10 is a view showing a positioning mechanism for the carriage in a Y-axis direction.

A sensor bar 103 is fixedly mounted further to the guide plate 77 having carried thereon the carriage 58, as shown in FIGS. 7 and 10. Mounted to this sensor bar is a lens-reversing and cutting-completing sensor 104 formed of a photo-interrupter. A Y-axis position detecting switching bar 105 is arranged in facing relation to the sensor 104. This bar moves in the Y-axis direction with rotation of a screw shaft 106. The screw shaft 106 is rotated by a driving servomotor 110 through a pulley 107, a belt 108 and a pulley 109. An amount of movement of the switching bar 105 is detected by a Y-axis position detecting rotary encoder 114 through a pulley 111 fixedly mounted to the screw shaft 106, a belt 112 and a pulley 113. In this connection, this rotary encoder 114 may be mounted directly to an output shaft of the servomotor 110.

On the basis of the lens-frame configuration data, the control circuit 10 causes the driving servomotor 110 to move the switching bar 105. Thus, the central axes of the respective lens rotating shafts 59 and 60 are located on the envelope G with respect to the central axis of the grindstone rotary shaft. Movement of the switching bar 105 is, of course, carried out in relation to the lens rotational angle detected by the rotary encoder 76. The servomotor 110 is controlled by feed-back control, while carrying out the position detection by the Y-axis position detecting rotary encoder 114.

The switching bar 105 is arranged in facing relation to a switch button 115 for the lens-reversing and cutting-completing sensor 104, as shown in FIG. 10. This switching button 115 is mounted to a forward end of a rod with interrupting plate 117 biased toward the switching bar 105 by a spring 116. This rod with interrupting plate 117 is supported by the sensor bar 103 for axial sliding movement. At a point of time of initiation of lens cutting, the switch button 115 is spaced from the switching bar 105. As cutting proceeds, the switching button 115 approaches the switching bar 105, and is abutted against the switching bar 105 to compress the spring 116, thereby moving the bar with interrupting plate 117 toward the lens-inverting and cutting-completing sensor 104 to operate the same. The operation of the sensor 104 continues over a period equal to or larger than 360 degrees of rotational angle of the lens 11, whereby cutting is completed. Thus, the wire-rope winding AC motor 90 is operated through the control circuit 10, and the lens driving AC motor 61 and a grindstone drive motor 118 are stopped. By operation of the wire-rope winding AC motor 90, the wire rope 89*b* is wound up so that the carriage 58 together with the guide plate 77 is pulled up to the origin position upward in the Y-axis direction.

The grindstone 12 is a diamond grindstone provided at its outer peripheral surface with the rough grinding section, the V-shaped (bevel) grinding section and the like. The grindstone 12 is rotatively driven by the grindstone drive motor 118 through a pulley 119, a belt 120, a pulley 121 and a spindle shaft 122. Rotative driving of the grindstone motor 118 is controlled by the motor and clutch drive unit 17 having a motor drive circuit.

Further, in order for the peripheral edge of the processed lens to have a ridge-like projection, that is, a V-shaped projection extending along the entire periphery of the lens, the grindstone 12 can be equipped with a measuring mechanism for measuring the configuration of the peripheral edge of the processed lens.

As described above, the arrangement of the invention is such that the lens 11 is rotated about, for example, its geometric center, and the rotational axis of the lens 11 is moved toward and away from the rotational axis of the grindstone 12 along the envelope G serving as the cutting data, in accordance with the rotational angle of the lens 11, thereby carrying out processing of the peripheral edge of the lens. Since the lens-frame configuration data can be stored in the computer, it is possible to process a plurality of lenses and to control a plurality of lens peripheral-edge processing machines, on the basis of this single data.

We claim:

1. A method of processing a peripheral edge of a lens to be ground, wherein said lens is to be fitted in a lens frame of a spectacle framework, said lens being rotatable about its rotational axis, and using a disc-shaped measuring probe having a radius and a columnar grindstone having a radius, the grindstone being rotatable about its rotational axis, said method comprising the steps of:

(a) moving the measuring probe along an inner periphery of the lens frame to measure a closed locus along which a center of the measuring probe moves;

(b) computing a plurality of circles having their respective centers located on said locus, each of said circles having a radius which is equal to a sum of the radius of the columnar grindstone and the radius of the measuring probe;

(c) computing a closed envelope by which outermost edge points of said respective circles are connected to each other in tangential relation to said outermost edge points; and (d) moving the rotational axis of the lens along said envelope relative to the rotational axis of the columnar grindstone to grind the peripheral edge of the lens, thereby forming a lens which is fitted in the lens frame.

2. The method according to claim 1, comprising the further step of selecting the radius of the measuring probe so that it is smaller than a minimum value of a plurality of radii which form the inner periphery of the lens frame.

3. The method according to claim 1, wherein step (a) is practiced so that said locus is represented by a system of point coordinates about an optional point within the lens frame.

4. The method according to claim 1, comprising the further step of rotating the measuring probe about its rotational axis.

5. An apparatus for processing a peripheral edge of a lens to be ground, wherein said lens is to be fitted in a lens frame of a spectacle framework, said lens being rotatable about its rotational axis, said apparatus comprising:

a disc-shaped measuring probe having a radius;

a columnar grindstone having a radius, said grindstone being rotatable about its rotational axis;

first moving means for moving said measuring probe along an inner periphery of said lens frame to measure a closed locus along which a center of said measuring probe moves;

means for computing a plurality of circles having their respective centers located on said locus, each of said circles having a radius which is equal to a sum of the radius of said columnar grindstone and the radius of said measuring probe;

means for computing a closed envelope by which outermost edge points of the respective circles are connected to each other in tangential relation to said outermost edge points; and second moving means for moving the rotational axis of said lens along said envelope relative to the rotational axis of said columnar grindstone to grind the peripheral edge of said lens, thereby forming a lens which is fitted in said lens frame.

6. The apparatus according to claim 5, wherein the radius of said measuring probe is selected to a value smaller than a minimum value of a plurality of radii which form the inner periphery of said lens frame.

7. The apparatus according to claim 5, wherein said locus is represented by a system of polar coordinates about an optional point within said lens frame.

8. The apparatus according to claim 5, further comprising a carriage for holding said lens, said carriage being movable under its gravitational weight toward said grindstone, and spring means for biasing said carriage away from said grindstone, said spring means having an amount of deflection which is adjustable.

9. The apparatus according to claim 5, wherein said second moving means restricts movement of the rotational axis of said lens toward the rotational axis of said grindstone, on the basis of said envelope and a rotational angle of said lens.

10. The apparatus according to claim 5, wherein said measuring probe is rotatable about its rotational axis.

11. An apparatus for processing a peripheral edge of a lens to be ground, wherein said lens is to be fitted in a lens frame of a spectacle framework, said lens being rotatable about its rotational axis, said apparatus comprising:

a disc-shaped measuring probe having a radius;

a columnar grindstone having a radius and rotatable about its rotational axis;

means for moving said measuring probe along an inner periphery of said lens frame to measure a closed locus along which a center of said measuring probe moves;

means for measuring a distance between an optical point within said lens frame and a center of said measuring probe;

means for measuring an angle defined between a straight reference line passing through said optional point and a straight line passing through said optional point and the center of said measuring probe;

first arithmetic means for computing a plurality of circles on the basis of said distance and said angle, said circles having their respective centers located on said locus, each of said circles having a radius which is equal to a sum of the radius of said columnar grindstone and the radius of said measuring probe;

second arithmetic means for computing a closed envelope by which outermost edge points of the respective circles are connected to each other in tangential relation to said outermost edge points;

control means for controlling said lens so as to move the rotational axis of said lens along said envelope relative to the rotational axis of said columnar grindstone; and means for holding said lens to rotate the same about its rotational axis, and for urging said lens against the rotating grindstone to grind the peripheral edge of said lens, thereby forming a lens which is fitted in said lens frame.

12. The apparatus according to claim 11, wherein the radius of said measuring probe is selected to a value smaller than a minimum value of a plurality of radii which form the inner periphery of said lens frame.

13. The apparatus according to claim 11, further comprising a carriage for holding said lens, said carriage being movable under its gravitational weight toward said grindstone, and spring means for biasing said carriage away from said grindstone, said spring means having an amount of deflection which is adjustable.

14. The apparatus according to claim 11 wherein said control means controls said lens so as to restrict movement of the rotational axis of said lens toward the rotational axis of said grindstone, on the basis of said envelope and the rotational angle of said lens.

15. The apparatus according to claim 11, wherein said measuring probe is rotatable about its rotational axis.

* * * * *